US005911568A

United States Patent [19]

Kirschner et al.

[11] Patent Number: 5,911,568

[45] Date of Patent: Jun. 15, 1999

[54] REGULATED GAS SOURCE FOR UNDERWATER GUN OPERATION

[75] Inventors: Ivan N. Kirschner, Portsmouth; Laurence M. Dean; Richard L. Bonin, both of Newport; James E. Mulherin, Portsmouth, all of R.I.

[73] Assignee: The United States of America as represented by the Secretary of the Navy, Washington, D.C.

[21] Appl. No.: 08/951,968

[22] Filed: Oct. 17, 1997

[51] Int. Cl.[6] ..... F41C 9/06

[52] U.S. Cl. ..... 42/1.14; 42/96; 89/30; 89/1.2

[58] Field of Search ..... 42/96, 1.14; 89/30, 89/31, 1.2

[56] References Cited

U.S. PATENT DOCUMENTS

| | | | |
|---|---|---|---|
| 425,574 | 4/1890 | Lassoe | 89/3 |
| 3,300,888 | 1/1967 | Belcher et al. | 42/1 |
| 3,453,763 | 7/1969 | Barr et al. | 42/59 |
| 3,455,047 | 7/1969 | Hoag | 42/1 |
| 3,616,561 | 11/1971 | Hendricks | 42/1 |
| 4,019,480 | 4/1977 | Kenaio | 124/61 |
| 5,639,982 | 6/1997 | Cipolla | 89/1.11 |
| 5,648,631 | 7/1997 | Kirschner et al. | 89/1.14 |
| 5,687,501 | 11/1997 | Stace et al. | 42/1.14 |

*Primary Examiner*—Charles T. Jordan
*Assistant Examiner*—Chris J. Brown
*Attorney, Agent, or Firm*—Michael J. McGowan; Prithvi C. Lall; James M. Kasischke

[57] ABSTRACT

The present invention relates to an underwater weapon having a barrel with an opening through which a projectile is discharged. The weapon further has an apparatus for pressurizing the interior of the barrel to a pressure greater than the ambient pressure to keep water from entering the gun barrel at any point around the circumference of the muzzle opening. The pressurizing apparatus includes a source of gas, a pressure regulator for adjusting the flow of the gas and the pressure within the barrel, and a distribution network for distributing the gas near the muzzle opening and at an end of the barrel remote from the muzzle opening.

10 Claims, 3 Drawing Sheets

REGULATED GAS SOURCE FOR UNDERWATER GUN OPERATION

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED APPLICATION(S)

This application is related to U.S. Pat. No. 5,648,631, filed on 3 Oct. 1995 for a SPOOLED METAL TAPE SEAL FOR UNDERWATER GUN OPERATION.

BACKGROUND OF THE INVENTION (1) Field of the Invention

The present invention relates to an apparatus and a method for preventing the ingress of water into an underwater gun before, during, and after the firing of a projectile.

(2) Description of the Prior Art

Underwater weapons are known in the art. U.S. Pat. No. 3,323,457 to Biehl et al., U.S. Pat. No. 3,453,763 to Barr et al., U.S. Pat. No. 3,580,172 to Hendricks and U.S. Pat. No. 3,158,062 to Feiler illustrate some of these underwater weapons. Keeping the barrel of the weapon clear of water is important to underwater gun operation because it reduces the energy required to eject the projectile or bullet, it increases the muzzle velocities that can be achieved, and it reduces the strength requirements and thus the weight of the barrel.

In the Biehl et al. patent, the underwater weapon comprises a device for launching a projectile. One end of the projectile is covered by a frangible diaphragm. The diaphragm is used to maintain the watertightness of the launcher. In operation, the projectile within the launcher is ejected through the frangible diaphragm. The Barr et al. patent relates to an underwater pistol having a rotatable cylindrical magazine. During operation of this pistol, a projectile is driven through a frangible, and fully removable, sealed front barrel cover. The Hendricks patent also illustrates an underwater weapon in which a projectile resides within a launch tube or barrel having a removable plug affixed at one end to prevent the ingress of water.

The Feiler patent relates to an underwater missile container and launcher which includes a device for maintaining an internal pressure within the launcher which is substantially equal to the pressure of the surrounding environment. The launcher further includes a cap over the launch tube which prevents the ingress of water prior to the launch.

Other devices are known in the art to render firearms waterproof. U.S. Pat. No. 3,677,132 to Plenge illustrates a muzzle attachment for the barrel of a firearm. The muzzle attachment includes a device for sealing it behind a bullet passing therethrough to prevent the escape of expanding gases. This device takes the form of a plurality of polyurethane discs sandwiched between flat metallic washers and spaced apart by ring members. The plugs are X-slotted on both faces thereof for permitting a bullet to pass therethrough without fragmenting or rupturing the element. The disc or plug automatically closes and reseals itself after a bullet has been fired. When the muzzle attachment is threadably engaged with the gun barrel, the weapon is waterproof from the barrel end thereof. U.S. Pat. No. 5,105,571 to Kinchin et al. also relates to a method and apparatus for preventing moisture from entering a firearm. In this patent, lightweight plastic covers are disclosed for use as seals for the openings of a firearm such as the muzzle opening or the magazine well opening. The plastic covers are removable through manual operation. It is also possible to remove the covers by actually firing the weapon.

U.S. Pat. No. 4,848,209 to Almeras discloses sealing a driving apparatus for an underwater device. The apparatus includes a barrel holder, a barrel for guiding a fastener intended to be driven by the gases of a propulsive charge and a percussion system for setting of the charge. The barrel of the device is closed by a closure device made by a material which may be perforated by the projectile disposed inside the tubular element or gun barrel.

U.S. Pat. No. 4,742,775 to Harris illustrates still another approach for sealing an end of an underwater device. In the Harris patent, a sealing compound is used to prevent water from penetrating the casing.

Despite the existence of these devices for sealing and pressurizing underwater weapons and the like, there is still a need for a more efficient approach for preventing the ingress of water into a gun barrel and, in particular, to an approach wherein a series of shots can be fired without water entering the weapon.

SUMMARY OF THE INVENTION

Accordingly, it is an object of the present invention to provide an improved apparatus for keeping water out of a gun barrel.

It is a further object of the present invention to provide an apparatus as described above which maintains a dry state in the gun barrel and which purges the barrel of the products of combustion.

Still further, it is an object of the present invention to provide an improved apparatus as described above which helps prevent gun barrel corrosion caused by exhaust gases.

The foregoing objects are attained by the apparatus of the present invention.

In accordance with the present invention, an underwater weapon has a tube, such as a gun barrel, having an opening, such as a muzzle opening, through which a projectile, such as a bullet, is to be discharged. The underwater weapon further has a means for pressurizing the interior of the gun barrel to a pressure greater than ambient pressure so as to keep water from entering the gun barrel. The pressurizing means includes a pressure regulator to maintain the pressure within the gun barrel at a desired level and a check valve to insure that propellant gases discharged in the gun barrel do not overpressurize the barrel or source of the pressurizing gas.

The method of the present invention broadly comprises providing an underwater weapon having an opening such as a muzzle opening and pressurizing the interior of said underwater weapon so as to prevent water from entering the underwater weapon through the opening.

Other details, objects and advantages of the present invention are set forth in the following detailed description and the accompanying drawings wherein like reference numerals depict like elements.

DETAILED DESCRIPTION OF THE PREFERRED EMBODIMENT(S)

Figure 1:
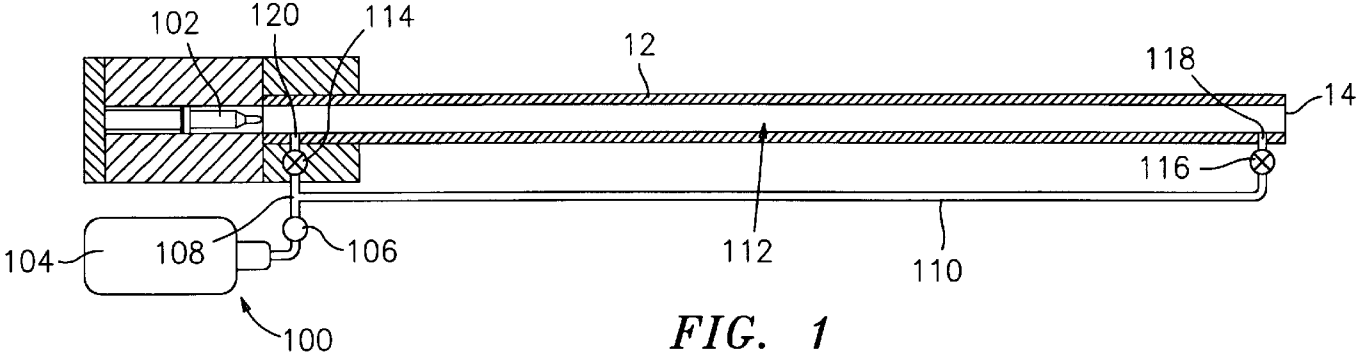
FIG. 1 is a sectional view of a gun barrel in the ready condition incorporating the water ingress prevention apparatus of the present invention.
Figure 2:
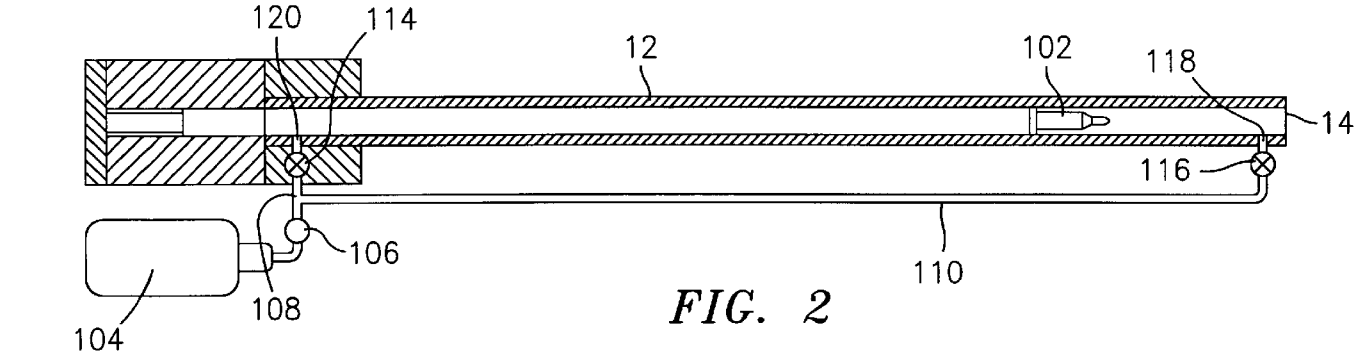
FIG. 2 is a sectional view of the gun barrel of FIG. 1 at peak pressure.
Figure 3:
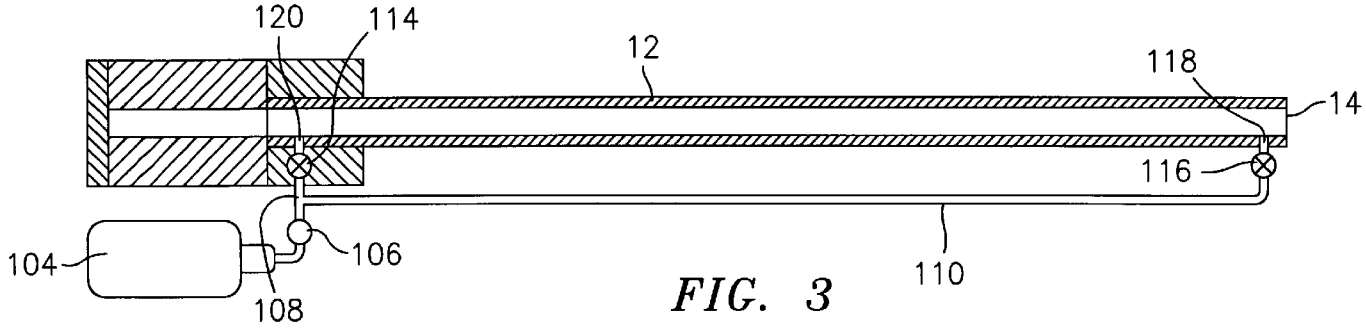
FIG. 3 is a sectional view of the gun barrel of FIG. 1 between rounds.

Referring now to the drawings, FIGS. 1–3 illustrate the gun pressurization system 100 of the present invention at various points of operation. FIG. 1 illustrates the gun pressurization system in a ready firing position. FIG. 2 illustrates the gun pressurization system at peak pressure during operation. FIG. 3 illustrates the gun pressurization system between rounds.

As shown in these figures, the gun pressurization system 100 is mounted to a gun barrel 12. The gun barrel 12 has an opening 14 through which a projectile 102 positioned within the gun barrel is discharged. The projectile 102 may be a bullet or some other form of projectile.

The gun pressurization system 100 comprises a system for pressurizing the gun barrel 12 with a gas, such as an inert gas, so that the pressure within the gun barrel is above ambient pressure. By doing this, the interior of the gun barrel 12 can be maintained in a dry state. Further, the products of combustion caused by the firing of the projectile 102 can be purged from the barrel.

Referring to FIG. 1, the gun pressurization system includes a source 104 of gas such as a supply of inert gas and a pressure regulator 106. The purpose of the pressure regulator 106 is to adjust the flow of the gas from the source 104 into the gun barrel. The pressure regulator 106 may comprise any suitable regulator known in the art; however, preferably, the regulator which is used should be capable of sensing the presence of exhaust gases in the barrel, which are expelled after each firing, and adjust the gas flow rate into the barrel accordingly. The gas pressurization system 100 also includes conduits such as 108 and 110 for supplying gas from the source 104 to the interior 112 of the gun barrel preferably near each end of the gun barrel and check valves 114 and 116.

A muzzle port 118 is provided in communication with muzzle check valve 116. Breech check valve 114 is in communication with a breech port 120. In operation, gas is fed from the source 104 to the interior of the gun barrel via conduits 108 and 110. The gas is maintained at a pressure greater than the ambient pressure, preferably slightly over the ambient pressure, by pressure regulator 106. This ensures that gas flowing from muzzle port 118 moves out of the opening 14 so as to keep the interior 112 free of water. This also insures that presence of a gas flow around the circumference of the muzzle opening 14 which prevents entry of water into the gun barrel 12 at any point around the circumference of the opening 14. Multiple ports 118 and 120 can be provided to ensure a uniform gas distribution.

As shown in FIGS. 1–3, gas is also fed to the interior 112 of the gun barrel at breech port 120 remote from the opening 14 via conduit 108. This is done to ensure that the gun barrel 12 remains free of water along substantially its entire length.

During and after firing a projectile, propellant gases will remain in the interior 112 of the gun barrel. Check valves 114 and 116 are provided in the pressurization system 100 to establish a one-way flow so that these propellant gases are prevented from over pressurizing the gas source 104. Any suitable check valve arrangement known in the art may be used for check valves 114 and 116. Eventually, the propellant gases within the interior 112 of the gun barrel are purged by the gas which is introduced into the interior 112 of the gun barrel.

Keeping the barrel dry is important in underwater gun operations because (1) bullets achieve higher muzzle velocities with a dry barrel and (2) firing bullets through a dry barrel, as opposed to a barrel filled with water, reduces the strength requirements of the barrel, permitting a reduction in weight. Further, purging of the products of combustion from the barrel after a firing is important for safety considerations and to prevent barrel corrosion caused by exhaust gases.

Figure 4:
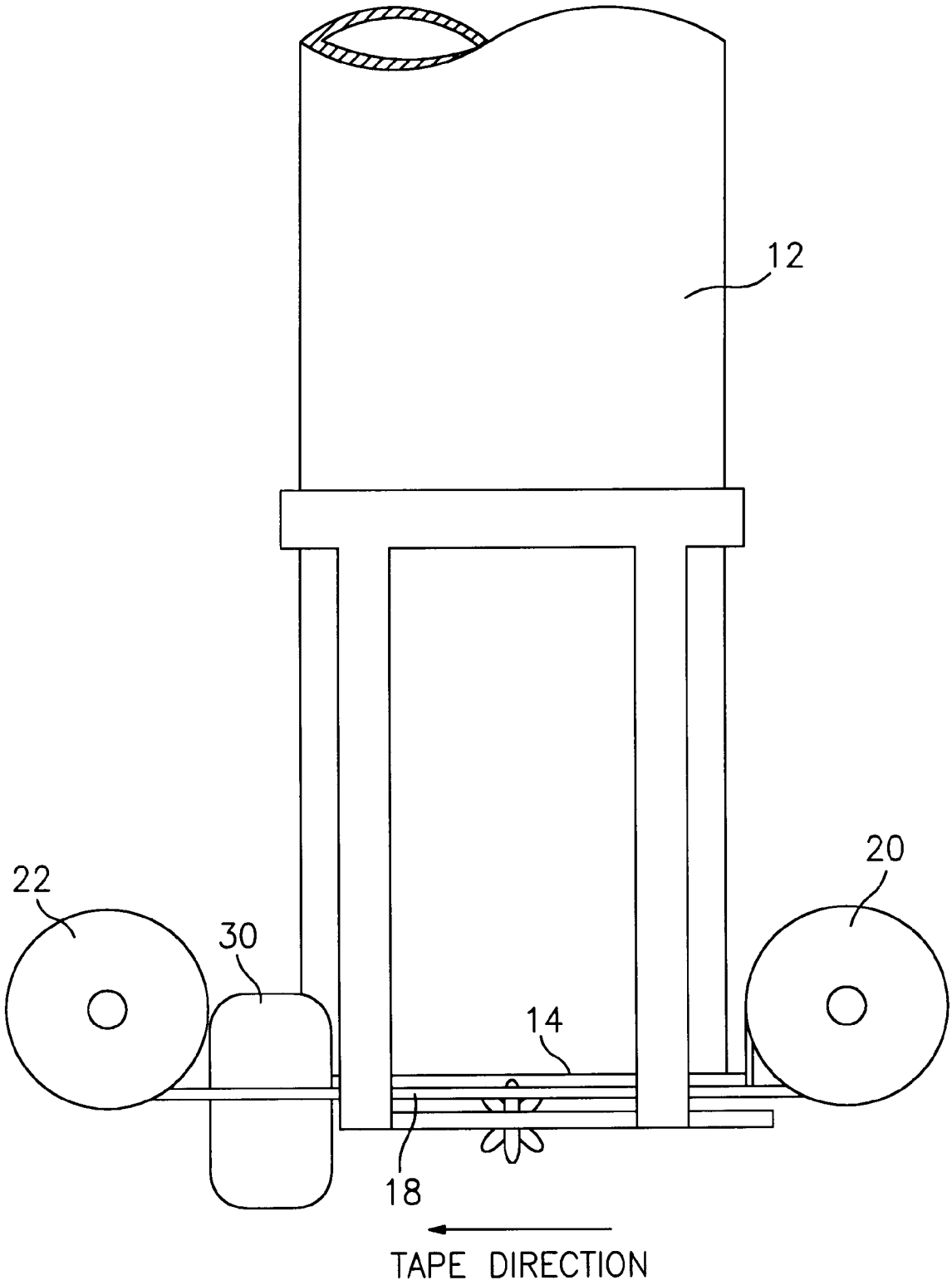
FIG. 4 illustrates a spooled tape sealing system mounted to the gun barrel of FIGS. 1–3.

Accordingly, it is also desirable to keep the barrel free from fluid. In order to accomplish this, a device such as a spooled tape seal or a rotating disk seal can be used. The spooled tape seal is taught by U.S. Pat. No. 5,648,631 to Kirschner et al. As shown in FIG. 4, the spooled tape seal incorporates a tape spool 20 on one side of barrel 12 and a take up spool 22 on the other side of barrel 12. The tape 18 extends between spools 20 and 22 and across barrel muzzle 14. A drive means 30 is used to advance tape 18 after a projectile discharges and punctures tape 18.

Figure 5:
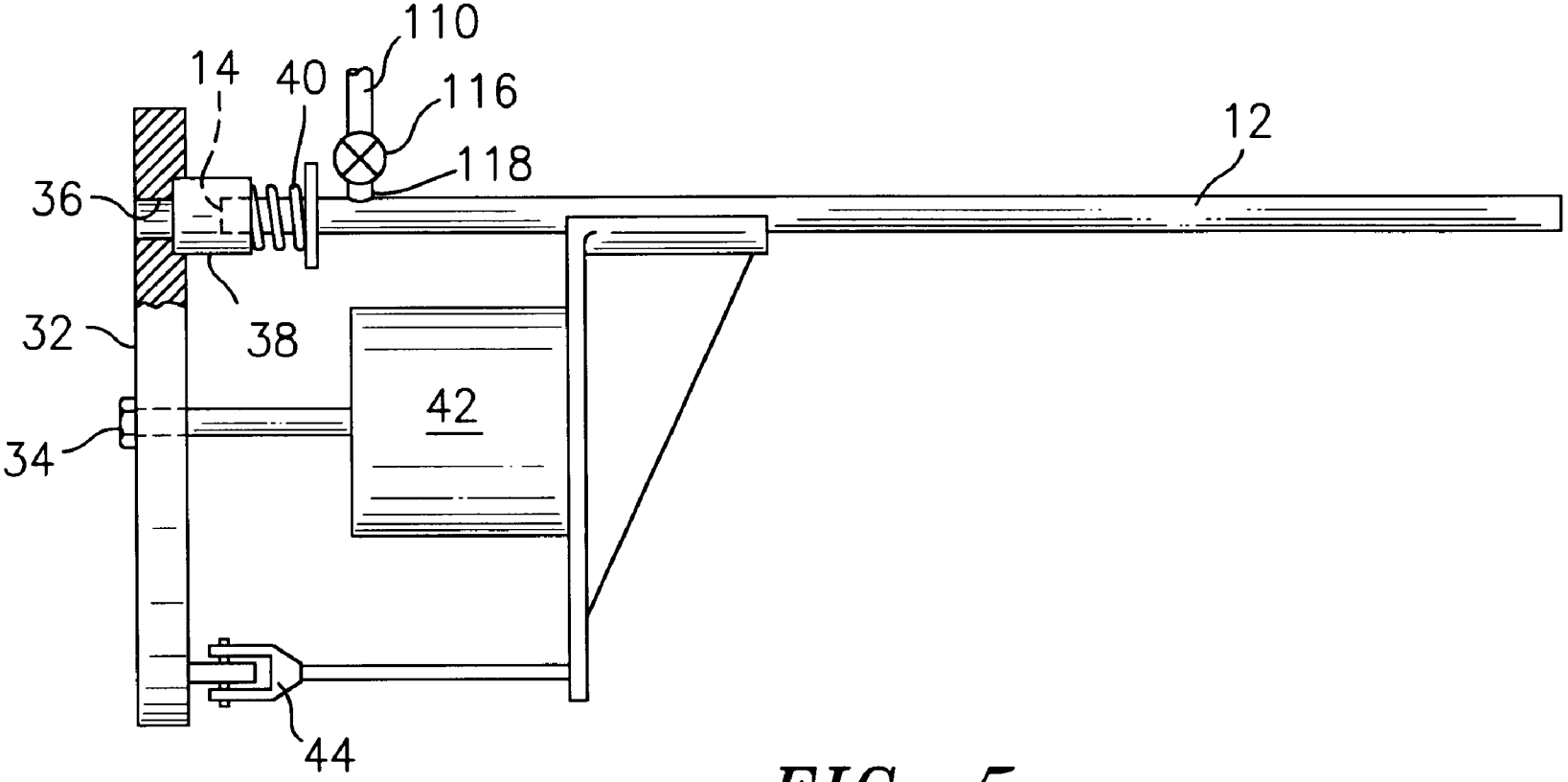
FIG. 5 illustrates a rotating disk seal which can be mounted to the gun barrel of FIGS. 1–3.

Another means for keeping the barrel free from fluid is the rotating disk seal taught by U.S. patent application Ser. No. 08/613,814, now U.S. Pat. No. 5,687,501. As shown in FIG. 5, the rotating disk seal incorporates a rotating plate 32 affixed to gun barrel 12 by a drive shaft 34. Rotating plate 32 has a plurality of apertures 36 therein. A face seal 38 is joined to muzzle 14 of gun barrel 12 to seal gun barrel 12 against plate 32. Face seal 38 is biased against plate 32 by a spring 40. Muzzle port 118 can be joined to gun barrel 12 near muzzle 14. As in FIGS. 1–3, muzzle port 118 is joined to check valve 116 and regulated gas line 110. A drive system 42 rotates plate 32 so that aperture 36 is in communication with muzzle 14 during firing. After firing, drive system 42 rotates plate 32 such that muzzle 14 is blocked by plate 32 to seal gun barrel 12. Plate 32 is balanced by a support 44 also affixed to barrel 12.

It is apparent that there has been provided in accordance with this invention a regulated gas source for underwater gun operation which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An underwater gun comprising:

a gun barrel having a muzzle opening through which a projectile is discharged; and pressurizing means in communication with the interior of said gun barrel and pressurizing said gun barrel to a pressure greater than ambient pressure to keep water from entering the gun barrel, said pressurizing means comprising:

a source of gas capable of supplying gas under pressure; and a pressure regulation means in communication with said source of gas and the interior of said gun barrel for adjusting the interior pressure to a pressure slightly greater than said ambient pressure to insure that said gas moves out of said gun barrel through said muzzle opening.

2. The underwater gun of claim 1 wherein said gas source comprises a source of relatively inert gas.

3. The underwater gun of claim 1 further comprising a valve means in communication between said pressure regulation means and the interior of said gun barrel.

4. The underwater gun of claim 3 wherein said valve means comprises a check valve.

5. The underwater gun of claim 1 further comprising a sealing means for sealing said muzzle opening, said sealing means allowing discharge of said projectile through said muzzle opening.

6. The underwater gun of claim 5 wherein said sealing means comprises a spooled tape seal joined to said gun barrel and covering said muzzle opening for preventing environmental water from entering said gun barrel, said spooled tape seal having a tape which is perforated by the discharge of said projectile through said muzzle opening, and said spooled tape seal advancing said tape after said discharge to cover said muzzle opening with whole tape.

7. The underwater gun of claim 5 wherein said sealing means comprises a rotating disk seal joined to said gun barrel, said rotating disk seal having a rotating disk with an aperture therein and a drive means attached to said disk, said drive means aligning said rotating disk aperture with said muzzle opening to allow discharge of said projectile, and said drive means rotating said disk to seal said barrel after said discharge to cover said muzzle opening with said rotating disk.

8. The underwater gun of claim 1 further comprising a distribution network joined to said pressure regulation means and in communication with the interior of said gun barrel near said muzzle opening and near a breech end of said gun barrel distal from said muzzle opening.

9. A method for preventing the ingress of water into an underwater gun barrel opening, said method comprising:

providing a source of gas; and pressurizing the interior of said gun barrel by supplying said gas at a pressure greater than the ambient pressure to the interior of said gun barrel so as to prevent the entry of water into said gun barrel opening.

10. The method of claim 9 further comprising the step of supplying said gas to a portion of said gun barrel remote from said gun barrel opening to purge propellant gases from said gun barrel.

* * * * *